US005839377A

United States Patent [19]

Brenny et al.

[11] Patent Number: 5,839,377

[45] Date of Patent: Nov. 24, 1998

[54] APPARATUS AND METHOD FOR APPLYING AND REMOVING TRANSVERSELY APPLIED ELASTIC RAIL CLIPS

[75] Inventors: David M. Brenny, Eagle; Gary L. Johnson, Racine, both of Wis.

[73] Assignee: Racine Railroad Products, Inc., Racine, Wis.

[21] Appl. No.: 799,156

[22] Filed: Feb. 14, 1997

[51] Int. Cl.[6] ..... E01B 29/00

[52] U.S. Cl. ..... 104/17.2

[58] Field of Search ..... 104/2, 17.1, 17.2

[56] References Cited

U.S. PATENT DOCUMENTS

| | | | |
|---|---|---|---|
| 3,690,264 | 9/1972 | Plasser et al. | 104/17 R |
| 3,722,422 | 3/1973 | Chandre et al. | 104/17 A |
| 4,319,392 | 3/1982 | Cutts | 29/402.08 |
| 4,320,707 | 3/1982 | McIlraath | 104/1 R |
| 4,479,440 | 10/1984 | Burr et al. | 104/17 A |
| 4,494,463 | 1/1985 | Young et al. | 104/17 A |
| 4,580,501 | 4/1986 | Collins et al. | 104/17 R |
| 5,074,219 | 12/1991 | Theurer et al. | 104/17.2 |
| 5,142,987 | 9/1992 | Freymuth et al. | 104/17.2 |
| 5,146,677 | 9/1992 | Holman et al. | 29/243.5 |
| 5,165,346 | 11/1992 | Piekarski | 104/17.2 |
| 5,191,838 | 3/1993 | Hansen | 104/2 |
| 5,269,225 | 12/1993 | Bosshart et al. | 104/2 |
| 5,431,107 | 7/1995 | Almaraz et al. | 104/2 |
| 5,586,502 | 12/1996 | Weber | 104/17.2 |

OTHER PUBLICATIONS

The Safelok System —A Way of Extending Rail Life and Reducing Operating Costs, Safelok Rail Systems (No Date ).

*Primary Examiner*—Mark Tuan Le
*Attorney, Agent, or Firm*—Nilles & Nilles

[57] ABSTRACT

A machine is capable of automatically applying and removing transversely applied rail clips such as the so-called Safelok-type clip. The machine preferably includes a workhead on which is disposed one or more applicator/remover mechanisms, each of which is capable of automatically applying and/or removing a clip. Each clip applicator/remover mechanism preferably includes a workarm which is pivotable transversely towards and away from the longitudinal centerline of the rail, a clip applicator tool mounted on the workarm, and a clip retractor tool mounted on the workarm. The resulting mechanism is capable of both applying and removing clips rapidly and efficiently while accommodating variations in position and orientation of the rail and/or the clips.

18 Claims, 10 Drawing Sheets

APPARATUS AND METHOD FOR APPLYING AND REMOVING TRANSVERSELY APPLIED ELASTIC RAIL CLIPS

BACKGROUND OF THE INVENTION

1. Field of the Invention

The invention relates to a method and apparatus for applying and removing elastic rail clips or fasteners and, more particularly, to a method and apparatus for applying and removing rail clips or fasteners which are applied by movement transverse to the longitudinal centerline of the rail.

2. Discussion of the Related Art

Elastic or spring clips or fasteners are used with increasing regularity to fasten rails to concrete or wooden ties. Some clips, such as the so-called "Pandrol e" clip, are applied by movement parallel with the longitudinal centerline of the rail. Others, such as the so-called "Safelok" clip, are applied by movement transverse to the longitudinal centerline of the rail. It is with the application and removal of transversely applied clips that the invention is concerned.

Safelok clips and other transversely applied clips are characterized by their insertion into and through a support shoulder imbedded or secured to a tie such that a toe or free end of the clip applies a holding force to the base of the rail either via direct contact with the rail or, in the case of concrete ties, via an intermediate insulator pad. The applied clips are held in position by latching contact with the sockets. Driving a clip into its rail tensioning position (generally known in the art as "applying" the clip) is a relatively difficult process because it requires the imposition of substantial forces to the base or heel of the clip in a direction transverse to the longitudinal centerline of the rail. Retracting or removing a previously applied clip for track maintenance or replacement is even more difficult because it requires the imposition of 1) transverse retraction forces of a magnitude comparable to the magnitude of the application forces required to apply the clip and 2) lateral compression forces of sufficient magnitude to squeeze the arms of the clip together to unlock the clip from the socket and to crush ballast lodged between the arms of the clip.

Previous attempts have been proposed to either apply or remove transversely applied clips. However, all such attempts exhibited some drawbacks and disadvantages, and no attempt has been made to provide a machine capable of automatically both applying and removing transversely applied clips.

Devices for applying transversely applied clips are disclosed in U.S. Pat. No. 4,494,463 to Young et al. (the Young patent), U.S. Pat. No. 5,165,346 to Piekarski (the Piekarski patent), and U.S. Pat. No. 5,269,225 to Bosshart et al. (the Bosshart patent). The Piekarski patent discloses a manually operated, lever actuated device having 1) a hook which hooks onto the head of the rail and 2) a pin which slips through the rail clip and which draws the clip towards the rail to apply the clip upon manual pivoting of the lever. This device is capable of applying only one clip at a time and, of course, cannot be operated automatically.

The Young patent and Bosshart patent disclose a machine having pivot arms which each bear an applicator tool which engages the heel of a clip and drive the clip transversely towards the rail to apply the clip. Both patents disclose two pivot arms for each rail with each pivot arm receiving respective gauge and field side applicator tools. The pivot arms are operated simultaneously by a hydraulic cylinder to apply both field and gauge side clips simultaneously. While the clip applicator machines of the Young and Bosshart patents are capable of applying multiple clips simultaneously and of being operated automatically, they are not easily adapted to accommodate variations in rail configuration, rail orientation, or clip orientation. Moreover, the machines disclosed in the Bosshart and Young patents, like the device disclosed in the Piekarski patent, cannot remove previously applied clips.

U.S. Pat. No. 4,580,501 to Collins (the Collins patent) discloses a clip extractor mechanism for automatically removing or extracting previously applied clips. The clip extractor mechanism disclosed in the Collins patent includes a pair of opposed abutment plates which are of identical structure and which are mounted on a support so as to be pivotable about an axis perpendicular to the rail. Each abutment plate supports a pair of pivot arms that are pivotable about an axis extending in parallel with the rail. In operation, the clip extractor mechanism is initially brought into contact with the rail head, and the abutment plates are then pivoted longitudinally towards one another to engage the clip arms so as to laterally compress the clips and to prepare them for removal. Then, the pivot arms are pivoted outwardly transversely away from the rail to drive the clips away from the rail. Hence, field and gauge side clips are removed automatically by the same mechanism. However, this mechanism is relatively intolerant to imperfectly positioned or orientated rails and/or clips and is incapable of applying clips.

OBJECTS AND SUMMARY OF THE INVENTION

It is therefore a primary object of the invention to provide a clip applicator/remover mechanism or method that is capable of automatically applying and removing a transversely applied rail clip or fastener ("automatically" as used herein meaning that the application and/or retraction forces are applied by a power-driven apparatus rather than manually).

A secondary object of the invention is to provide an apparatus or method which meets the first primary object and which is capable of operating quickly and efficiently.

In accordance with a first aspect of the invention, this object achieved by providing a machine that automatically actuates a clip applicator/remover mechanism in a first manner to drive the clip transversely towards the base so as to apply the clip and also automatically actuating the clip applicator/remover mechanism in a second manner to move the clip transversely away the base so as to remove the clip.

Preferably, the applicator/remover mechanism comprises a workarm which is movable transversely with respect to the rail, a clip applicator tool which is mounted on the workarm, and a clip retractor tool which is mounted on the workarm. The step of actuating the clip applicator/remover mechanism in the first manner comprises moving the workarm transversely towards the rail with the clip applicator tool in contact with the clip to drive the clip towards the longitudinal centerline of the rail. In the case of removing spring clips such as a so-called Safelock clip, the step of actuating the clip applicator/remover mechanism in the second manner comprises laterally compressing the clip using the clip retractor tool and then moving the workarm transversely away from the longitudinal centerline of the rail while the clip is compressed to pull the clip away from the rail. The step of laterally compressing the clip preferably comprises moving first and second retractor arms of the clip retractor tool longitudinally with respect to the rail so as to engage opposed sides of the clip and to compress the clip.

Another primary object of the invention is to provide an improved method of removing or extracting a transversely-applied rail clip.

In accordance with another aspect of the invention, this object is achieved by automatically actuating a clip applicator/remover mechanism in a first manner to drive the clip transversely towards the base, thereby preparing the clip for removal by centering the clip in the socket, and then automatically actuating the clip applicator/remover mechanism in a second manner to move the clip transversely away from the base, thereby removing the clip.

Preferably, the step of automatically actuating the clip applicator/remover mechanism in the second manner comprises preparing the clip for retraction by laterally compressing the clip, and then retracting the clip by moving the clip transversely away from the longitudinal centerline of the rail while the clip is laterally compressed.

Another primary object of the invention is to provide a machine which is capable of automatically applying and/or removing transversely applied rail clips.

In accordance with yet another aspect of the invention, this object is achieved by providing a support frame, a workarm which is supported on the support frame so as to be movable transversely with respect to a longitudinal centerline of a rail, a clip applicator tool mounted on the workarm and configured to engage the clip when the workarm moves transversely towards the longitudinal centerline of the rail, and a clip retractor tool which is supported on the support frame and which is configured to laterally compress the clip and to move the clip transversely away from the longitudinal centerline of the rail while the clip is laterally compressed.

Preferably, the workarm is supported directly on the support frame by being pivotably mounted on the support frame, and the clip retractor tool is supported indirectly on the support frame by being mounted on the workarm.

Still another primary object of the invention is to provide an improved rail clip retractor tool for removing or retracting a transversely applied rail clip.

In accordance with yet another aspect of the invention, this object is achieved by providing a housing and first and second retractor arms pivotably mounted on the housing. Each of the first and second retractor arms has a downwardly-extending finger configured to engage a side of a rail clip. The first and second retractor arms include intermeshing teeth which cause the second retractor arm to pivot upon pivoting of the first retractor arm to selectively pinch and release the clip.

These and other objects, features, and advantages of the invention will become apparent to those skilled in the art from the following detailed description and the accompanying drawings. It should be understood, however, that the detailed description and the specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and which.

DETAILED DESCRIPTION OF THE PREFERRED EMBODIMENTS

1. Resume

Figure 1:
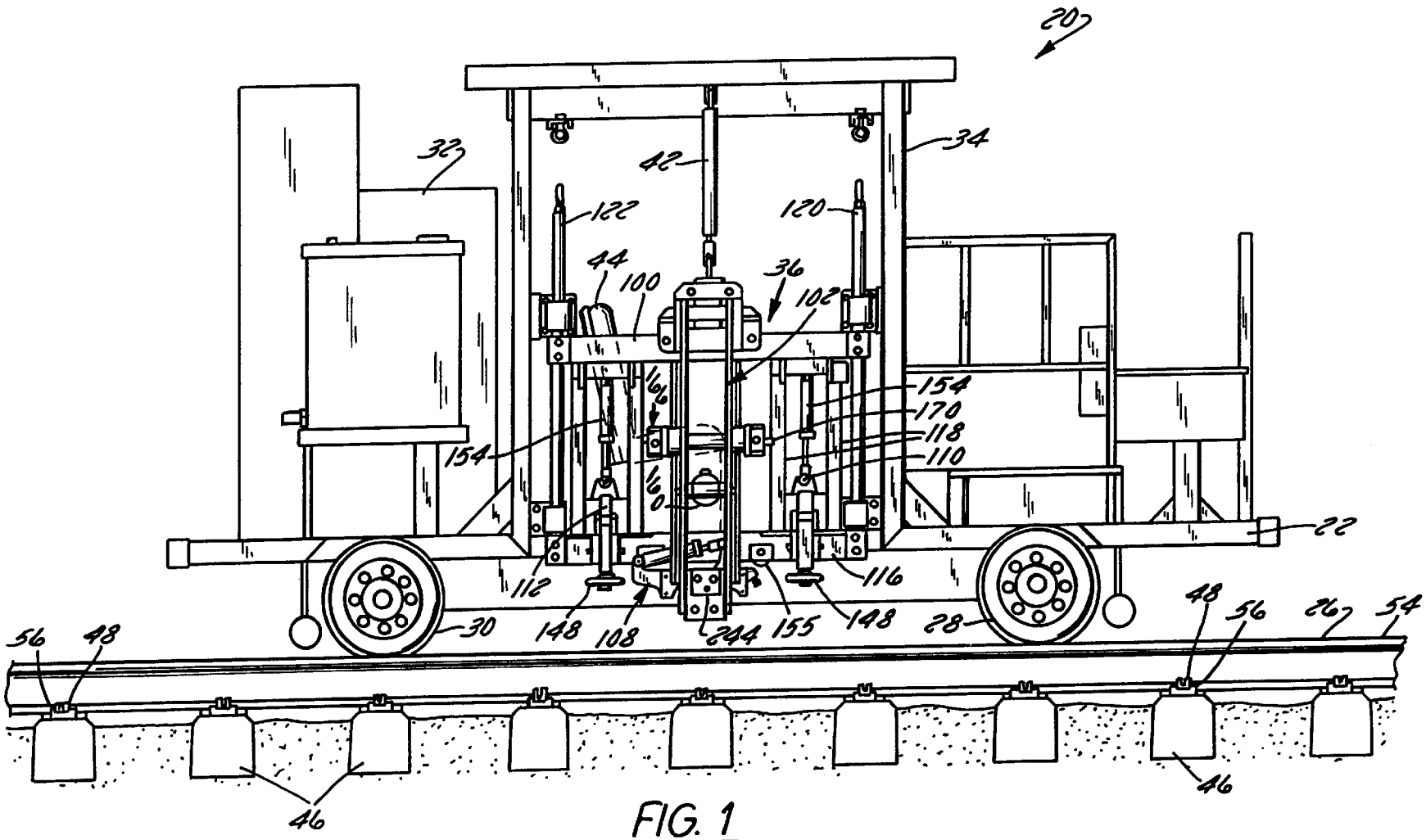
FIG. 1 is a side elevation view of a clip applicator/remover machine constructed in accordance with a preferred embodiment of the invention.

Pursuant to the invention, a machine is provided which is capable of automatically applying and removing transversely applied rail clips such as the so-called Safelok clip. The machine preferably includes a workhead on which is disposed one or more applicator/remover mechanisms, each of which is capable of automatically applying and/or removing rail clip. Each clip applicator/remover mechanism preferably includes a workarm which is pivotable transversely towards and away from the longitudinal centerline of the rail, a clip applicator tool mounted on the workarm, and a clip retractor tool mounted on the workarm. The resulting mechanism is capable of both applying and removing rail clips rapidly and efficiently while accommodating variations in position and orientation of the rail and/or the clips.

2. System Overview

Referring now to the drawings and initially to FIGS. 1–6, a clip applicator/remover machine 20 constructed in accordance with the present invention includes a self-propelled chassis 22 which is movably supported on opposed rails 24 and 26 by sets of front and rear wheels 28 and 30. Chassis 22 is driven by hydraulic motors (not shown) which are in turn driven by an engine 32. The chassis 22 presents a main frame 34 having first and second laterally opposed, longitudinally extending workheads 36 and 38 suspended therefrom by respective hydraulic lift cylinders 40 and 42. A seat 44 is mounted on the chassis 22 between the workheads 36 and 38 to provide a workstation for the operator.

The rails 24 and 26 are mounted on concrete ties 46 and held in place by clips 48 as detailed below. Each rail is conventional. Hence, referring to FIGS. 12–16 which illustrate a section of rail 26, each rail 24 or 26 includes a base 50, a web 52 extending vertically from a central portion of the base 50, and a head 54.

Figure 17:
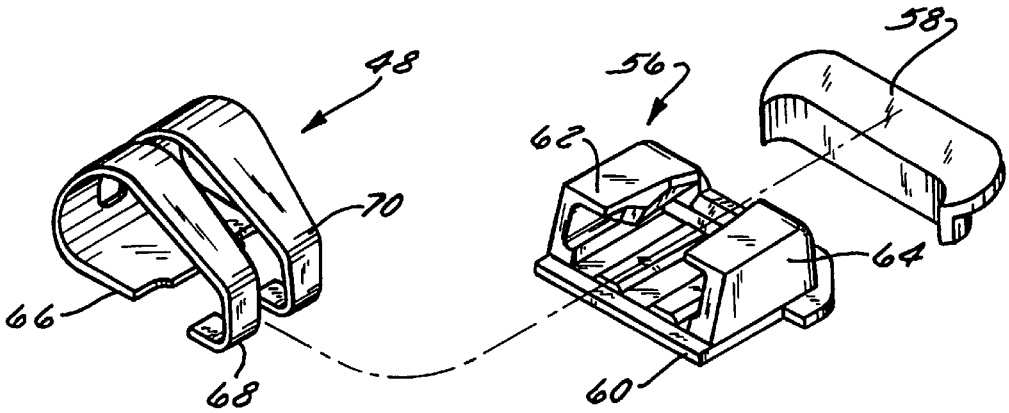
FIG. 17 is an exploded perspective view of an assembly comprising a rail clip, its associated socket, and their associated insulator pad.
Figure 18:
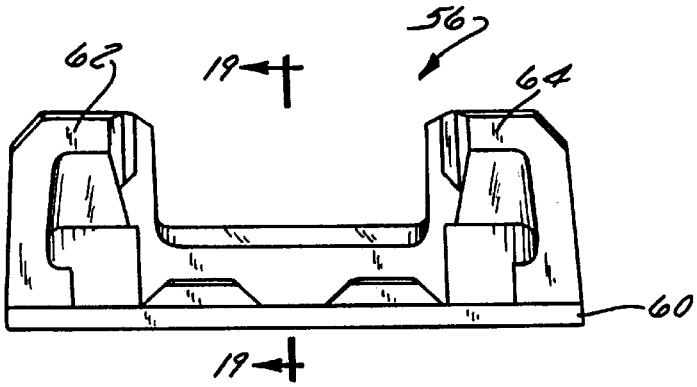
FIG. 18 is an end elevation view of the socket of FIG. 17.
Figure 19:
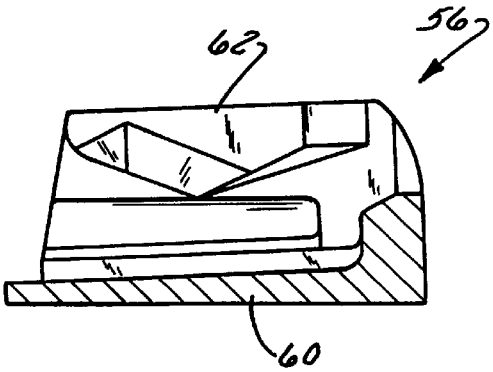
FIG. 19 is a sectional side elevation view taken generally along the lines 19—19 in FIG. 18.

The machine 20 may be adapted to apply and remove virtually any spring-type rail clip that is applied and removed by moving transversely with respect to the longitudinal centerline of the rail. For instance, it could be easily adapted for use with so-called "Fastclip" type clips. The illustrated embodiment is particularly well suited for applying and/or removing so-called "Safelok" type clips manufactured by Safelok Rail Systems of Montreal, Quebec, Canada. Referring especially to FIGS. 17–19, a Safelok clip 48 is illustrated as well as its associated socket 56 and insulator pad 58. The socket 56 is embedded in or otherwise fixed to the tie 46 adjacent the base 50 of the rail 26 as illustrated, for example, in FIGS. 12–16. The insulator pad 58 rests upon the base 50 of the rail 26.

The socket 56 includes a base 60 and a pair of opposed generally L-shaped walls 62 and 64 which extend upwardly from the base 60 and which present a pair of opposed latches which face the base 50 of the rail 26. A space is formed between these latches which is sufficiently wide to receive the arms of the clip 48 when the clip 48 is laterally compressed as detailed below.

The clip 48 includes 1) a heel or base 66 configured for seating on the base 60 of the socket 56 and 2) two curved arms 68 and 70 which extend forwardly from the base 66 towards the base 50 of the rail 26 to terminate in toes which impose tension on the base 50 of the rail through the insulator pad 58. The clip 48 and socket 56 are dimensioned and configured relative to one another such that a gap is normally formed between the arms 68 and 70. The gap is sufficiently wide that, in the uncompressed state of the clip 48, the curved arms 68 and 70 abut against the latches formed by front surfaces of the socket walls 62 and 64 to prevent clip retraction, i.e., to prevent movement of the clip 48 transversely away from the rail 26. However, if the arms 68 and 70 are pinched or squeezed together to compress or even eliminate this gap, a clearance can then be formed between the side edges of the arms 68 and 70 and the walls 62 and 64 of the socket 56 to permit retraction of the clip 48 without interference from the socket 56.

Each of the workheads 36 and 38 of the machine 20 is of identical construction and is designed to simultaneously apply and/or remove clips 48 from both the gauge and field sides one of the respective rails 24 or 26 (it being understood that one of the workheads could be eliminated such that the machine operates on only one rail at a time and that each workhead need not remove or apply two clips simultaneously). Since both workheads 36 and 38 are of identical construction, only the workhead 38 will be described in detail with reference to FIGS. 3–6. The workhead 38 includes a frame 100 on which is mounted two clip applicators/remover mechanisms. Each clip applicator/remover mechanism preferably comprises a workarm 102 or 104 and an associated clip applicator tool 106 and a clip retractor tool 108. A pair of longitudinally spaced rail clamp assemblies 110 and 112 are also mounted on the workhead frame 100.

The workhead frame 100 includes upper and lower horizontal, longitudinally extending bars 114 and 116 connected to one another by a plurality (six in the illustrated embodiment) of vertical supports 118. The front and rear ends of each of the upper and lower bars 114 and 116 are clamped or otherwise affixed to front and rear guide rods 120 and 122 to permit the workhead 38 to be raised and lowered relative to the main frame 34 upon extension or retraction of the lift cylinder 42. Each of the guide rods 120 and 122 is in turn slidably supported in upper and lower trunions 124 and 126. These trunions 124 and 126 could be fixed to the chassis main frame 34. However, it is preferred that the trunions 124 and 126 be configured to allow some swinging motion of the workhead 38 relative to the main frame 34 while maintaining nominal centrality between the workhead 38 and the rail 26 so as to accommodate conditions in which the machine 20 is tilted to one side or the other.

Figure 4:
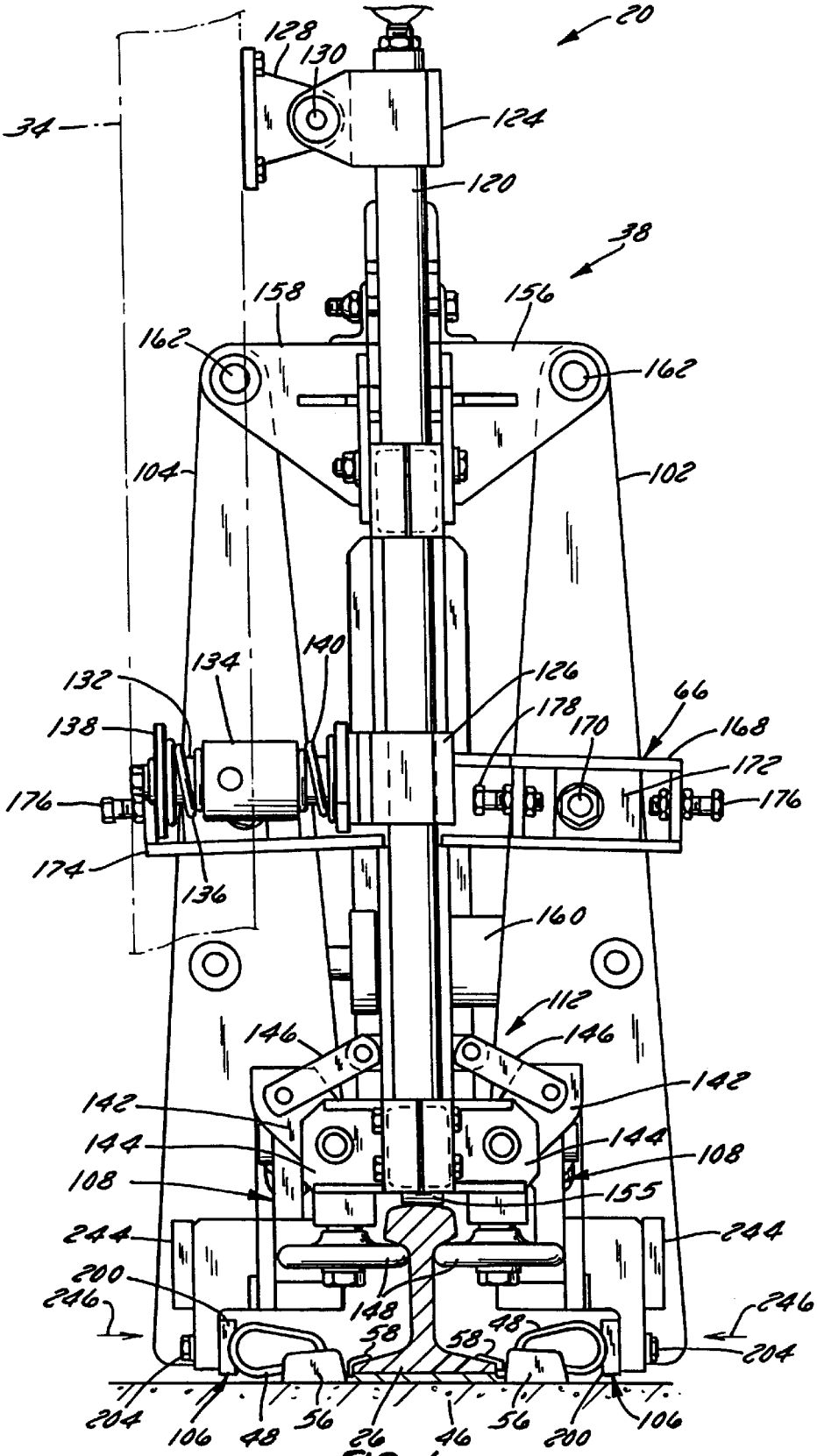
FIG. 4 is a sectional end elevation view of the workhead of FIG. 3 taken generally along the lines 4—4 in FIG. 3.

Towards this end, and referring particularly to FIG. 4, the upper trunion 124 is pivotably mounted on the main frame 34, and the lower trunion 126 is coupled to the main frame 34 so as to allow the trunion 126 to move horizontally and vertically with respect to the main frame. Specifically, the upper trunion 124 is mounted on a bracket 128 of the main frame 34 by a pivot pin 130 extending in parallel with the longitudinal centerline of the rail 26. The lower trunion 126 is mounted on a generally horizontal rod 132 that in turn extends through a third, generally horizontal trunion 134 pivotably mounted on the main frame 34. A first spring 136 surrounds the rod 132 and is seated at its inner end on the third trunion 134 and at its outer end on a stop 138 fixed to the end of the rod 132. A second spring 140 also surrounds the rod 132 and is seated at its inner end on the third trunion 134 and at its outer end on the trunion 126. The springs 136 and 140 serve to nominally center the trunion 126 with respect to the trunion 134 while permitting some relative swinging motion of the workhead frame 100 relative to the main frame 34. The pivotable connection of the third trunion 134 on the main frame 34 permits the trunion 126 to swing in an arc upon pivotable movement of the upper trunion 124 about the pin 130.

3. Construction of Rail Clamp Assembly

Figure 5:
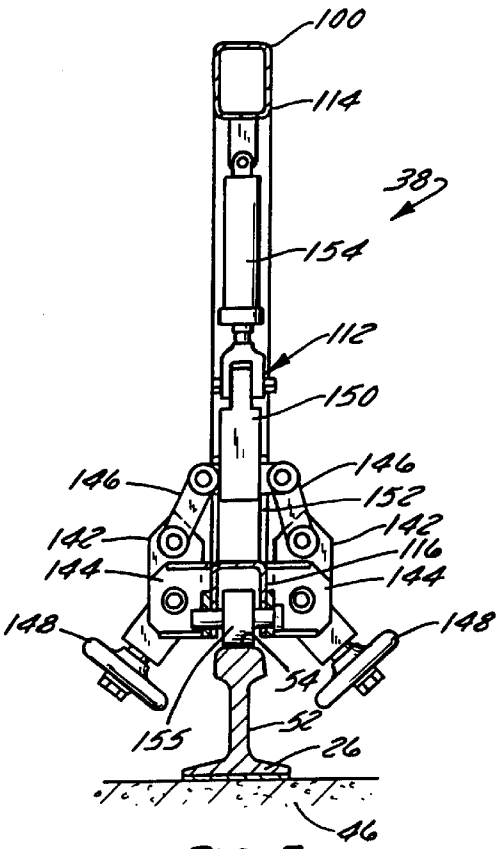
FIG. 5 is a sectional end elevation view of the workhead of FIG. 3 taken generally along the lines 5—5 in FIG. 3.

The rail clamp assemblies 110 and 112 permit the workhead 38 to be supported on the rail 26 and help to align the workhead 38 with the longitudinal centerline of the rail 26. In the illustrated embodiment, the fore and aft rail clamp assemblies 110 and 112 each include clamping arms or pivot arms 142 pivotably mounted on opposed sides of the workhead 38 as best seen in FIGS. 4 and 5. Each pivot arm 142 is pivotably connected to a bracket 144 at a central portion thereof and has an upper end pivotably connected to a pivot link 146 and a lower end rotatably receiving a clamp roller 148. As best seen in FIG. 5, both pivot links 146 are connected to a bar 150 which is in turn guided for vertical movement in a tube 152 formed in the workhead frame 100. The upper end of the bar 150 is in turn attached to the rod end of a hydraulic cylinder 154. Extension of the cylinder 154 from a retracted position illustrated in FIG. 5 drives the bar 150 downwardly so that the pivot arms 142 and rollers 148 pivot from the position illustrated in FIG. 5 in which the rollers 148 are spaced from the rail 26 to the position illustrated in FIG. 4 in which the rollers 148 clamp onto the web 52 of the rail 26 immediately beneath the head 54. The symmetrical interrelationship of the pivot arms 142 and their operation by a single centrally located cylinder 154 assure uniform displacement of both arms 142 and of the associated clamp rollers 148 with extension or retraction of the cylinder 154. Therefore, the clamp rollers 148 work in synchronization and assure that the rail 26 is precisely centered along the workhead frame 100 or conversely that the workhead frame 100 is precisely centered over the longitudinal centerline of the rail 26.

Working in conjunction with the clamp assemblies 110 is a roller 155 which is best seen in FIGS. 4 and 5 and which is rotatably mounted on the lower end of the same portion of the workhead frame 100 that receives the remainder of the clamp assembly 110. The roller 155 rests on the head 54 of the rail 26 when the workhead 38 is lowered to assure optimum vertical positioning of the workhead 38 relative to the rail clips 48 and to permit the workhead 38 to roll along the rail 26 during normal operation of the machine 20 so that the workhead 38 does not have to be raised and lowered between each successive clip application or removal operation.

4. Construction of Clip Applicator/Remover Mechanism

The clip applicator/remover mechanism is designed to be movable in a first manner to drive the clip 48 transversely towards the base 50 of the rail 26 so as to apply the clip 48 and to be movable in a second manner to move the clip 48 transversely away from the rail 26 so as to remove the clip 48. Two clip applicator/remover mechanisms are supported on the workhead 38 with one being operable to apply and/or remove field side clips and the other being operable to apply and/or remove gauge side clips. Each clip applicator/remover mechanism includes a clip applicator tool 106 and a rail clip retractor tool 108 working in conjunction with one another. In the preferred and illustrated arrangement, both tools 106 and 108 of each mechanism are mounted on a single workarm 102 or 104 movable transversely with respect to the longitudinal centerline of the rail 26.

Figure 6:
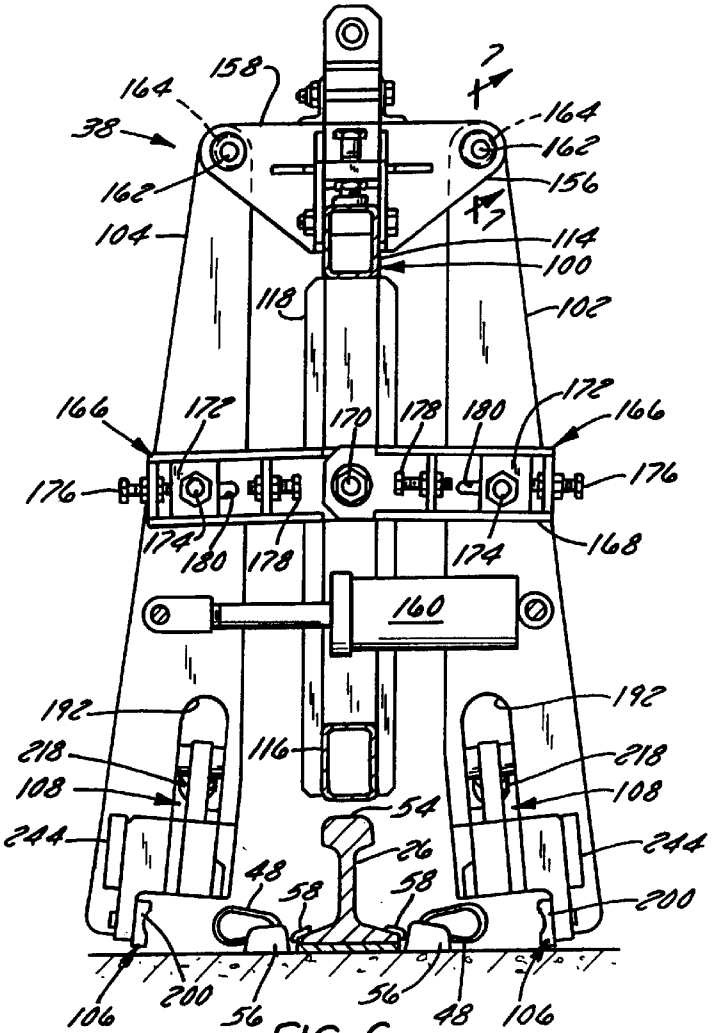
FIG. 6 is a sectional end elevation view of the workhead of FIG. 3 taken generally along the lines 6—6 in FIG. 3.

Transverse movement of both workarms 102 and 104 with respect to the workhead 38 is effected by pivotal movement of the workarms about axes extending generally in parallel with the longitudinal centerline of the rail 26. To this end, and as best seen in FIGS. 4 and 6, the upper end of each workarm 102 or 104 is pivotably connected to a pivot bracket 156 or 158 which in turn is fixed to the workhead frame 100. Symmetric and simultaneous movement of both workarms 102 and 104 is effected by a single hydraulic cylinder 160 having a cylinder end pivotably connected to one workarm 102 and a rod end pivotably connected to the other workarm 104.

Figure 7:
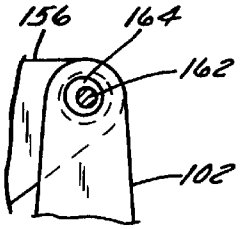
FIG. 7 is a detail view of the area illustrated in circle 7 in FIG. 6.

Connection of the workarm 102 or 104 to the bracket 156 or 158 could be effected by a simple pivot pin. However, this connected is effected in the preferred and illustrated embodiment by way of a cam-like mechanism that permits selective vertical adjustment of the workarm 102 or 104 relative to the workhead frame 100 to accommodate variations in rail cant. Referring to FIG. 7 which illustrates the upper end of workarm 102 and the associated portion of pivot bracket 156, cam operation is made possible by using as a pivot pin a shaft 162 that is offset from the centerline of a bore 164 in which an associated block (not shown) resides. Manual rotation of the block effects eccentric rotation of the shaft 162 to raise and lower the workarm 102 relative to the pivot bracket 156.

Figure 2:
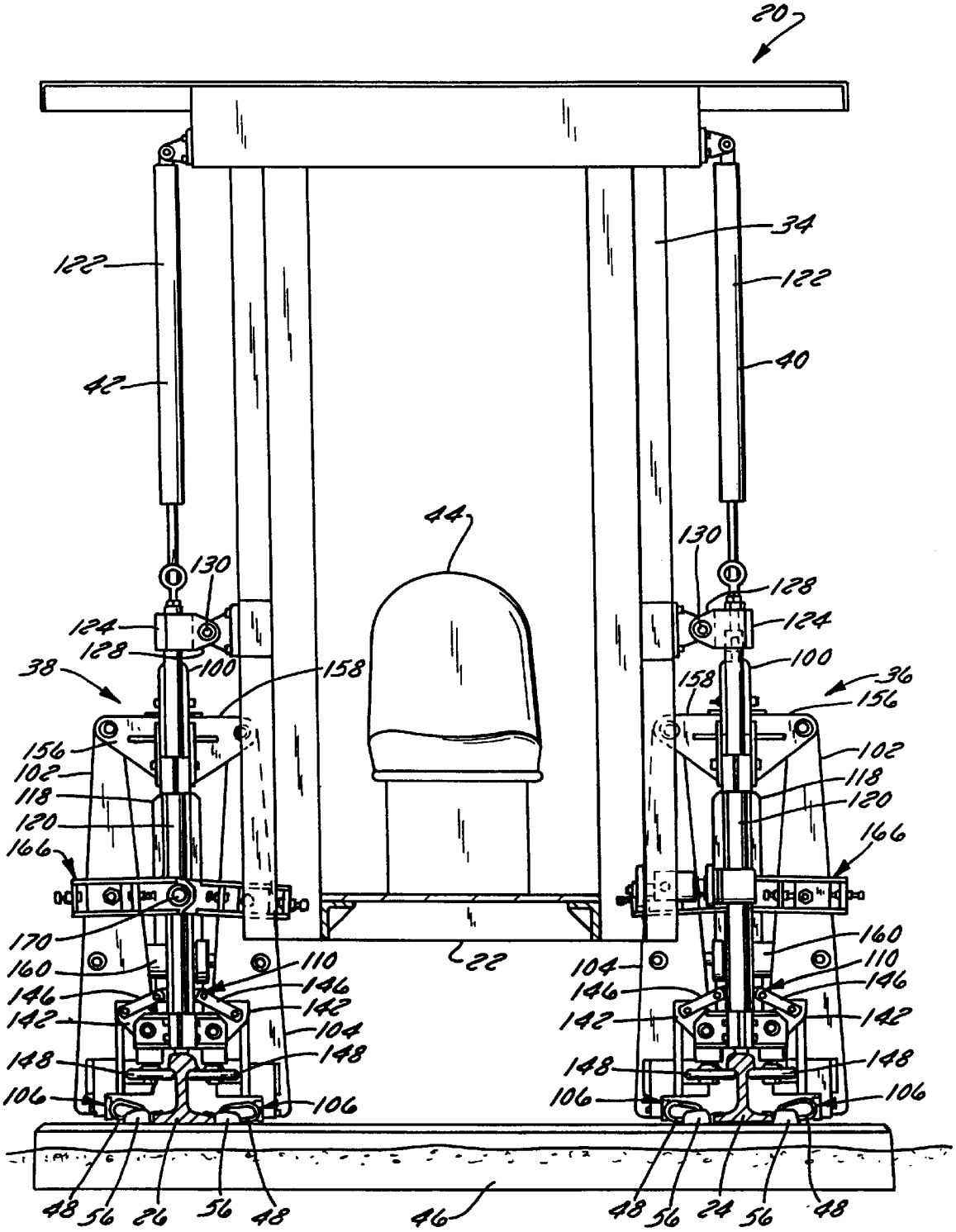
FIG. 2 is a front end elevation view of the machine of FIG. 1.

Referring to FIGS. 2, 4, and 6, the limits of pivotal movement of each workarm 102 or 104 is determined by a stop block assembly 166 located between the cylinder 160 and the pivot bracket 156. The stop block assembly 166 of each workarm 102 or 104 includes a generally horizontal frame 168 which is attached to the workhead frame 100 by a bolt 170 to define a passage. The passage slidably receives a stop block 172 attached to the workarm 102 or 104 by a cap screw 174. Stop bolts 176 and 178 are threaded into outer and inner walls of the frame 168 so as to be engaged by the stop block 172 upon pivotal movement of the workarm 102 or 104, thereby preventing further pivotal motion of the workarm relative to the workhead frame 100. The inner and outer limits of workarm motion can be adjusted by adjustment of one or more of the bolts 176 and 178 and/or by adjustment of the position of the stop block 172 on the workarm by moving the cap screw 174 along a slot 180 in the workarm 102 or 104.

Each workarm 102 or 104 and the associated clip applicator tool 106 and clip retractor tool 108 is identical instruction. Hence, only the workarm 102 and the associated clip applicator tool 106 and clip retractor tool 108 will be described in detail.

Figure 3:
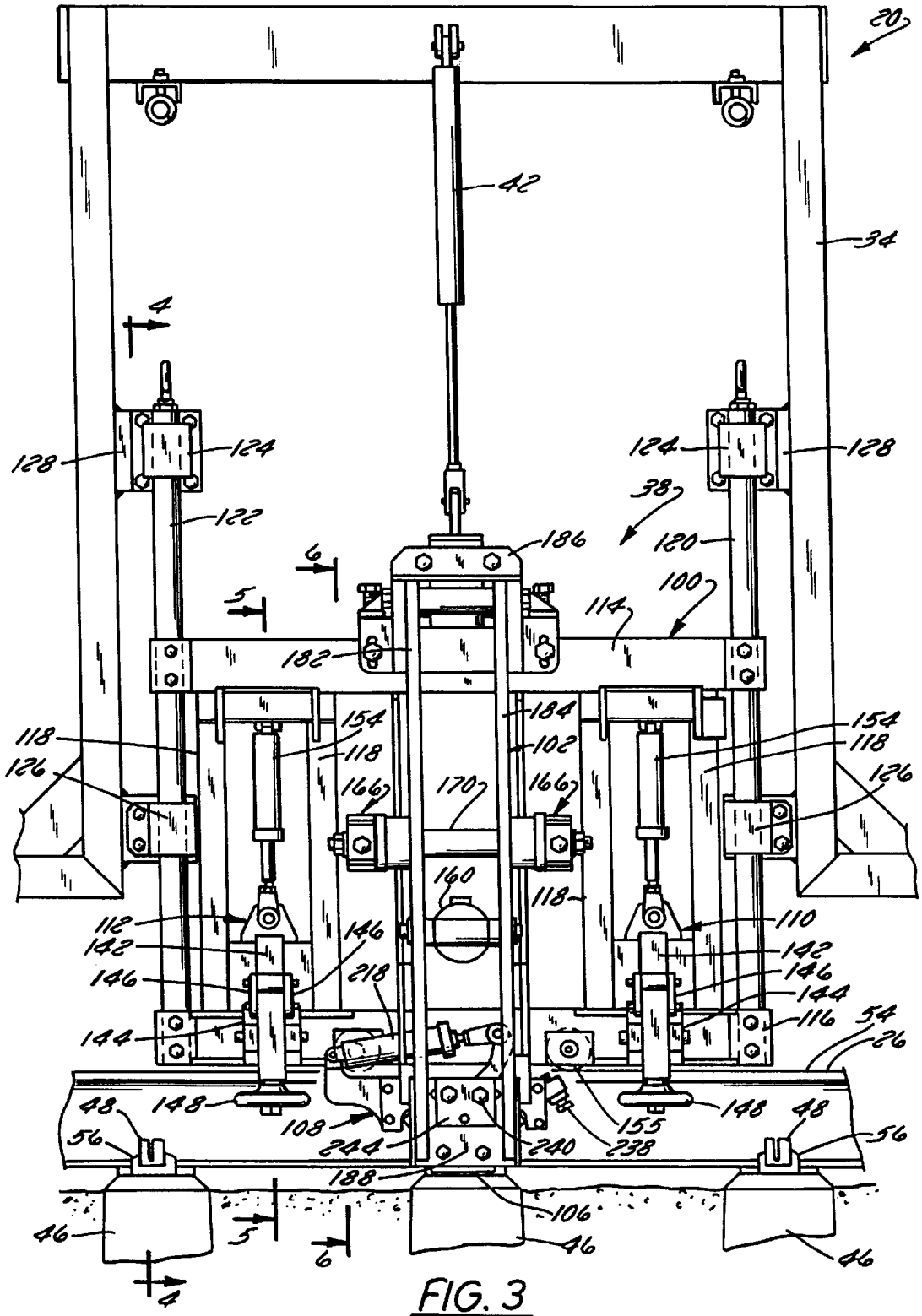
FIG. 3 is a side elevation view of a first workhead of the machine of FIGS. 1 and 2.
Figure 10:
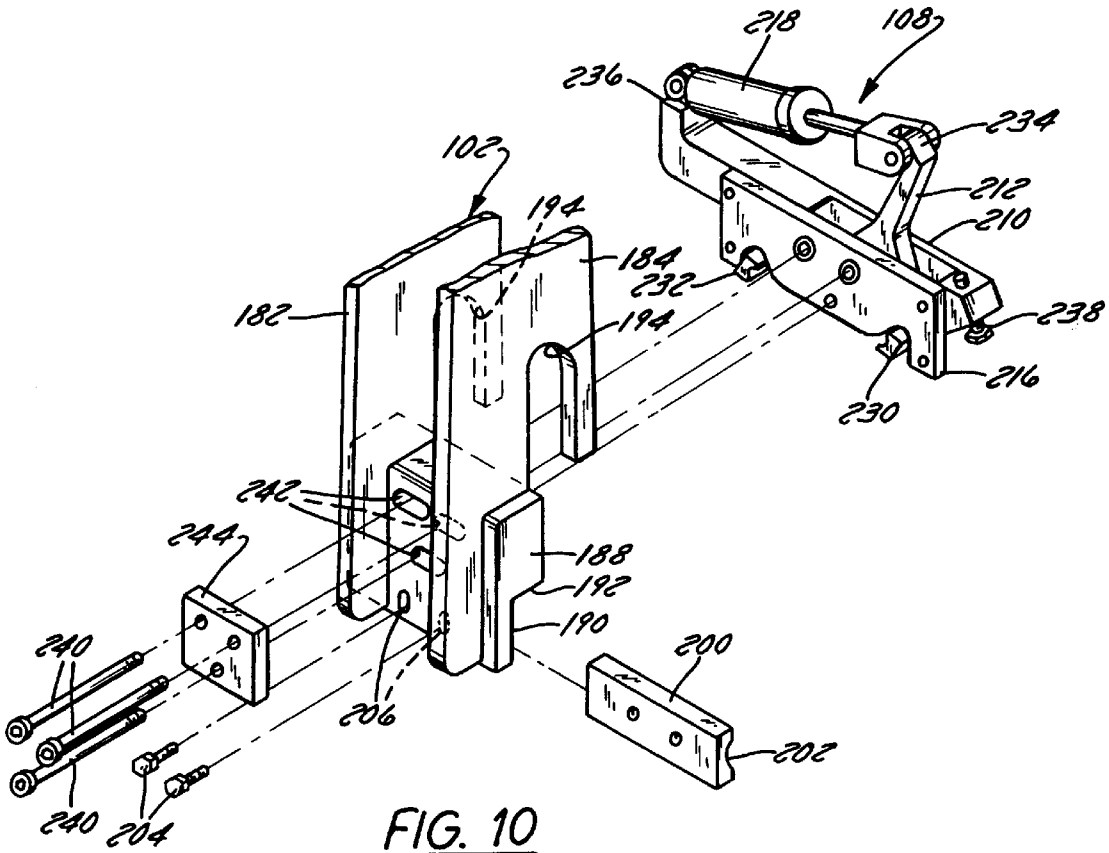
FIG. 10 is a partially exploded perspective view of 1) the clip retractor tool of FIGS. 8 and 9, 2) a clip applicator tool of the machine, and 3) the associated portion of the workarm on which the clip applicator tool and the clip retractor tool are mounted.
Figure 12:
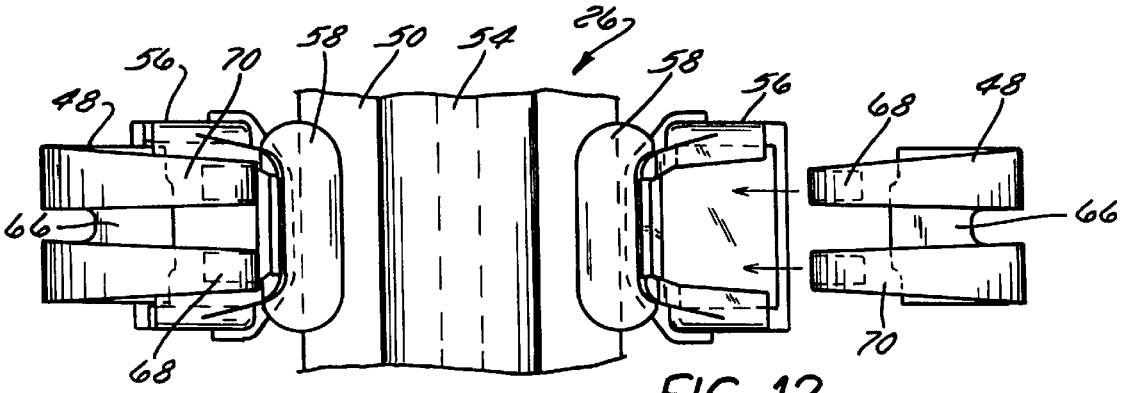
FIGS. 12 and 13 are plan and sectional end elevation views, respectively, illustrating movement of a field side clip towards the associated socket.
Figure 13:
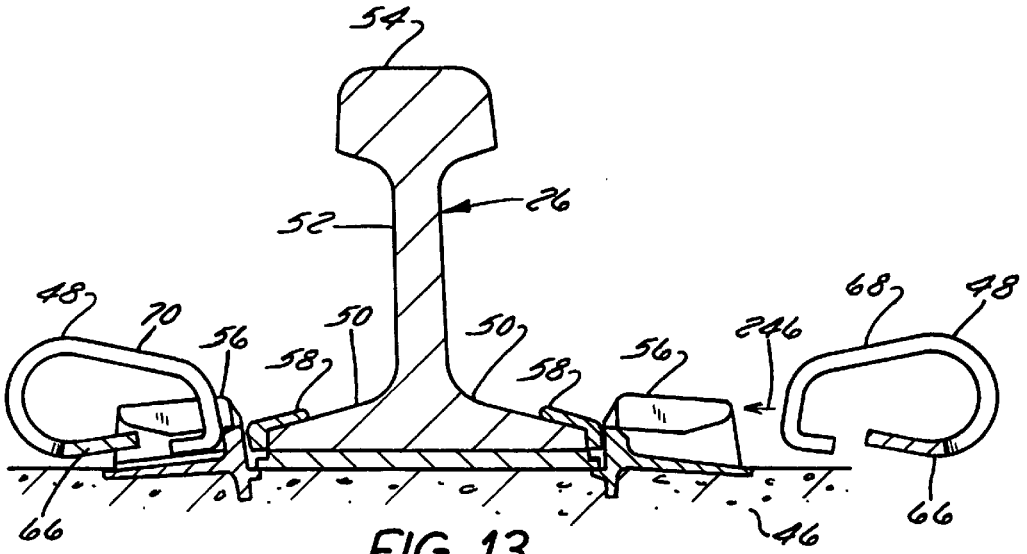

Workarm 102, best seen in FIGS. 1–6 and 10, is formed from a pair of longitudinally spaced, laterally extending side plates 182 and 184 (FIG. 10) connected to one another at their upper and lower ends by upper and lower blocks 186 and 188. The upper block 186 receives the pivot mount for connection to the pivot bracket 156 as best seen in FIG. 3. The lower block 188 is stepped at its bottom end portion as best seen in FIG. 10 so as to present a generally vertical surface 190 at its extreme bottom end bordered by a generally horizontal surface 192. The clip applicator tool 106 is attached to the generally vertical surface 190. A rather large upwardly extending notch 194 is formed in the side plates 182 and 184 above and in front of the generally horizontal surface 192 of the block 188 for receiving the clip retractor tool 108.

Figure 11:
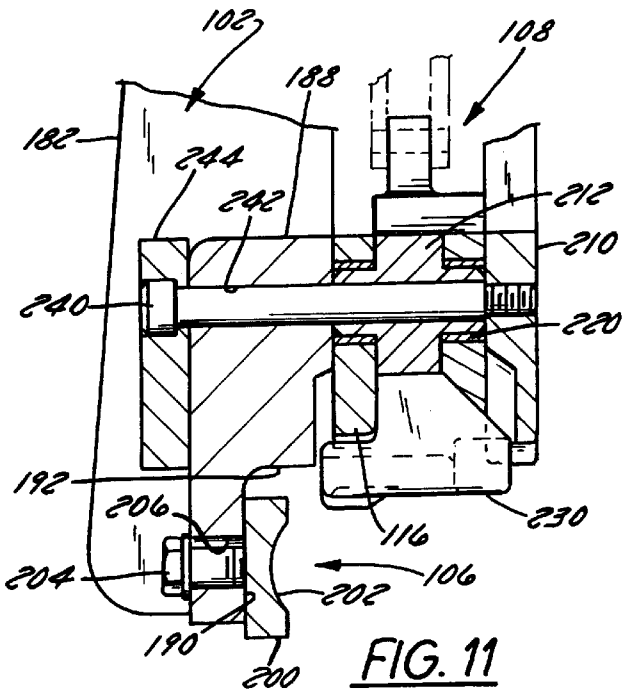
FIG. 11 is a sectional end elevation view of the structures illustrated in FIG. 10.

Referring especially to FIGS. 10 and 11, the clip applicator tool 106 comprises a metal drive plate 200 mounted on the bottom vertical surface 190 of the block 188 and positioned so as to engage the heel of the clip 48 upon transverse movement of the workarm 102 towards the rail 26. The inner or striking surface 202 of the drive plate 200 could be flat but preferably has a curved shape as seen in FIGS. 4, 6, 11 and 12 to compliment the shape of the heel of the clip 48. The drive plate 200 is bolted to the block 188 by cap screws 204 that extend through vertical slots 206 in the block 188 so as to permit limited vertical movement of the drive plate 200 relative to the workarm 102 and hence accommodate vertical movement of the clip 48 during a clip application procedure as detailed below.

Figure 8:
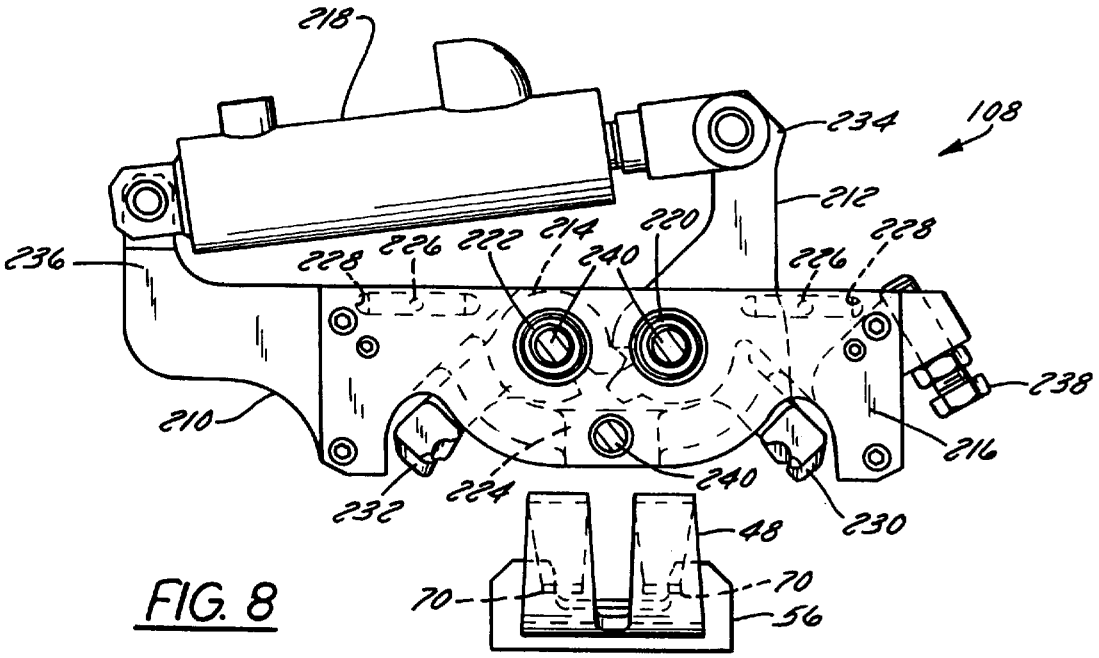
FIG. 8 is a side elevation view of a clip retractor tool of the machine of FIGS. 1–7, showing,the clip retractor tool in an open position.
Figure 9:
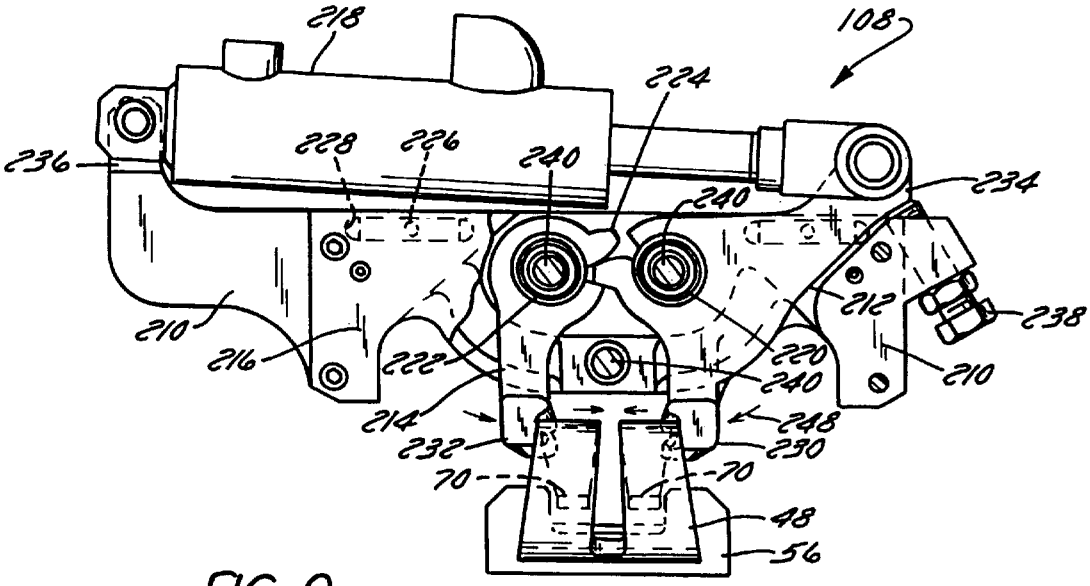
FIG. 9 is a side elevation view of the clip retractor tool of FIG. 8, showing the clip retractor tool in a closed or pinching position in which it engages the sides of a rail clip and laterally compresses the clip.

The clip retractor tool 108 is configured to laterally compress a clip 48 in preparation for a clip removal operation and to pull the clip 48 transversely away from the rail 26 upon subsequent pivotal movement of the workarm 102 transversely away from the rail 26. Referring especially to FIGS. 8–11, the clip retractor tool 108 includes a housing 210, first and second intermeshing retractor arms 212 and 214 pivotably mounted in the housing 210, a cover plate 216, and a single cylinder 218 for pivoting both retractor arms 212 and 214. The housing 210 is formed from a relatively thick metal block having a recess formed therein for receiving the retractor arms 212 and 214. The cover plate 216 is bolted to the housing 210 so as to sandwich the retractor arms 212 and 214 between the housing 210 and the cover plate 216. The first and second retractor 212 and 214 arms are pivotably mounted in the housing 210 by bearings 220 and 222. Intermeshing teeth 224 are formed on the retractor arms 212 and 214 so that pivoting of the first arm 212 drives the second retractor arm 214 to pivot simultaneously but in the opposite direction. Secured alignment between the bearing journals is assured by dowel pins 226 which ride in grooves 228 in the cover plate 216 and in the housing 210 as best seen in FIGS. 8 and 9. A clip-engaging finger 230 or 232 extends downwardly from a central portion of each of the retractor arms 212 or 214 and presents a surface which is curved to compliment the shape of the side of the clip 48. An end of the first retractor arm 212 extends above the housing 210 to present a pivot mount 234 for the rod end of the hydraulic cylinder 218. The cylinder end of the hydraulic cylinder 218 is pivotably connected to an upwardly-extending mount 236 formed on the rear end of the housing 210. Extension of the cylinder 218 from the position illustrated in FIG. 8 to the position illustrated in FIG. 9 causes the first and second retractor arms 212 and 214 to pivot into the position illustrated in FIG. 9 to compress the clip 48. The limit of this movement and of the consequent clip compression can be adjusted by a stop screw 238 which is threaded into the forward end of the housing 210 so as to be engaged by the first retractor arm 212 upon cylinder extension as seen in FIG. 9.

The entire clip retractor tool 108 is mounted on the workarm 102 so as to permit limited horizontal movement of the clip retractor tool 108 relative to the workarm 102 to accommodate some misalignment of the workarm 102 relative to the clip 48. Specifically, referring to FIGS. 10 and 11, the clip retractor tool 108 is mounted on the block 188 of the workarm 102 by three cap screws 240 that are received in corresponding horizontal slots 242 formed in the block 188. The cap screws 240 extend through an outer plate 244, through the block 188, through the cover plate 216, and are threaded into the housing 210. The upper two cap screws also extend through the bearings 230 and 222 to act as bearing supports. This arrangement permits the cap screws 240 to slide along the slots 242 in the block 188 and hence to permit the desired linear horizontal movement of the clip retractor tool 108 relative to the workarm 102.

5. Operation of Clip Applicator/Remover Machine

During operation, after the machine 20 is transported to the work site and mounted on the rails 24 and 26, the workheads 36 and 38 are lowered onto the rails 24 and 26 by operation of the lift cylinders 40 and 42. Workheads 36 and 38 then are clamped to the rails by operation of the cylinders 154 and by the consequent clamping operation of the clamp rollers 148. The magnitude of the clamping forces imposed by the clamp rollers 148 will depend upon the operational state of the machine 20. During operations in which the machine 20 is being transported from tie to tie, the clamping forces will be relatively light so as to not unduly hinder movement of the chassis 22 along the rails 24 and 26. It is preferable, however, that 1) these clamping forces be increased as the machine 20 nears the center of the tie 46 to which clips 48 are to be applied or removed so as to help brake the machine 20 and that 2) the forces be maximized when the workarms 102 and 104 are centered over the desired tie 46 so as to assure alignment between the rails and the workheads as described above.

Figure 14:
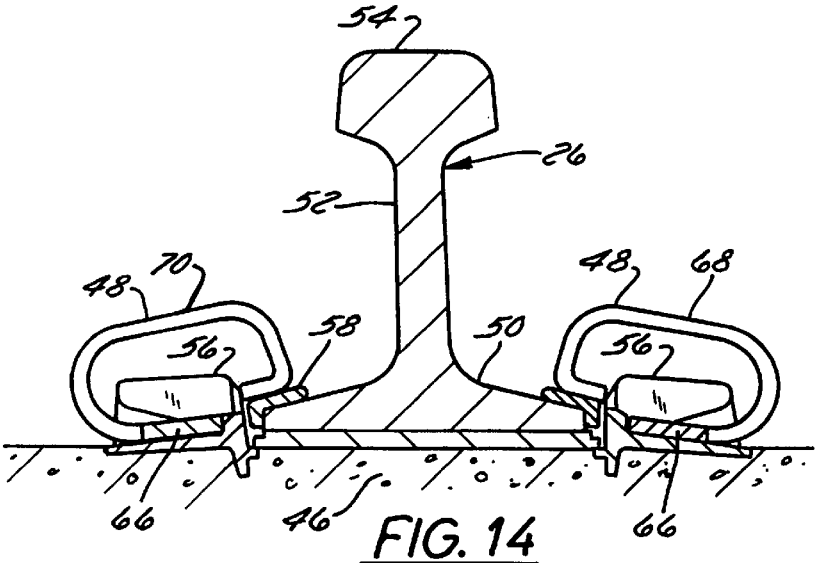
FIG. 14 is a sectional end elevation view illustrating both gauge and field side clips in their applied position.
Figure 15:
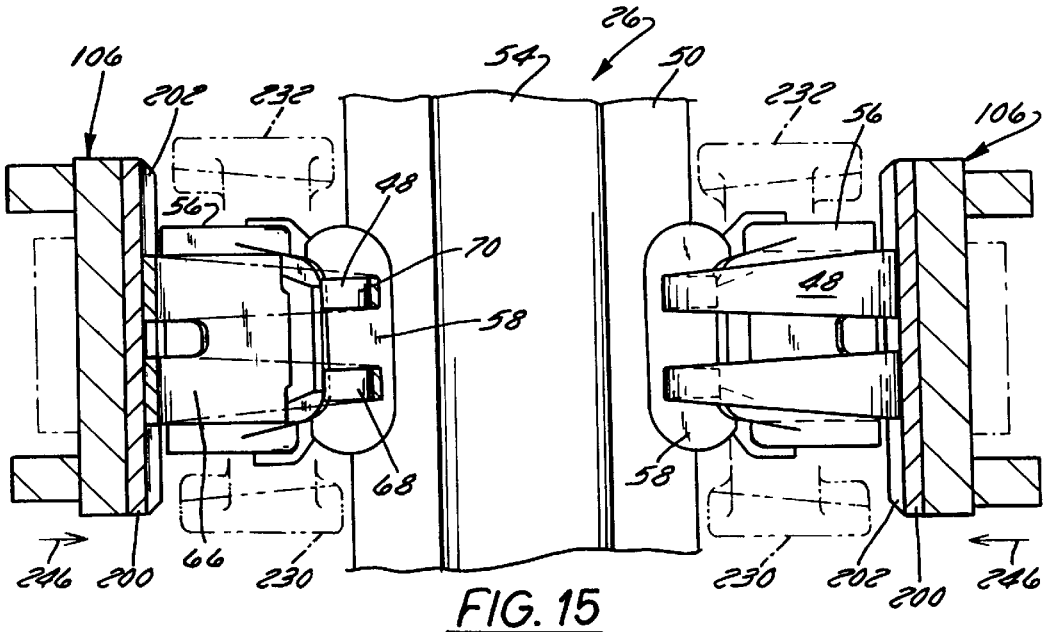
FIG. 15 is a top plan view illustrating the initial phase of a rail clip removal operation in which the clips are driven transversely towards the rail to center the clips in the sockets.

Assuming first that the machine 20 is being used to apply previously set clips, i.e., clips 48 that have been loosely inserted into the sockets 56, the cylinders 160 are actuated to pivot the workarms 102 and 104 transversely with respect to the rails 24 and 26 from the position illustrated in FIG. 6 to the position illustrated in FIG. 4, thereby driving the clips 48 into their applied positions as seen in FIGS. 14 and 15 via contact with the striking surfaces 202 of the applicator tools 200. Each clip 48 moves upwardly somewhat during this movement as it rides up the sloped bottom surface or base 60 of the socket 56. This vertical movement is accommodated by vertical movement of the cap screws 204 for the rail clip applicator drive plate 200 along the slots 206 in the block 188 of the workarm 102 or 104, thereby assuring that the heel of the clip 48 remains seated in the recess or pocket of the drive surface 202 of the clip applicator tool drive plate 200.

Assuming now that it is desired to remove or extract a previously applied clip, the applicator/remover mechanism associated with each workhead preferably effects a three step process.

First, the cylinder 160 is retracted to drive the workarms 102 and 104 towards the longitudinal centerline of the rails 24 and 26 as represented by the arrows 246 in FIG. 15. This assures that the each clip 48 is centered in the associated socket 56 and corrects any misalignment or misorientation of the clip 48 relative to the socket 56, thereby facilitating subsequent clip removal.

Figure 16:
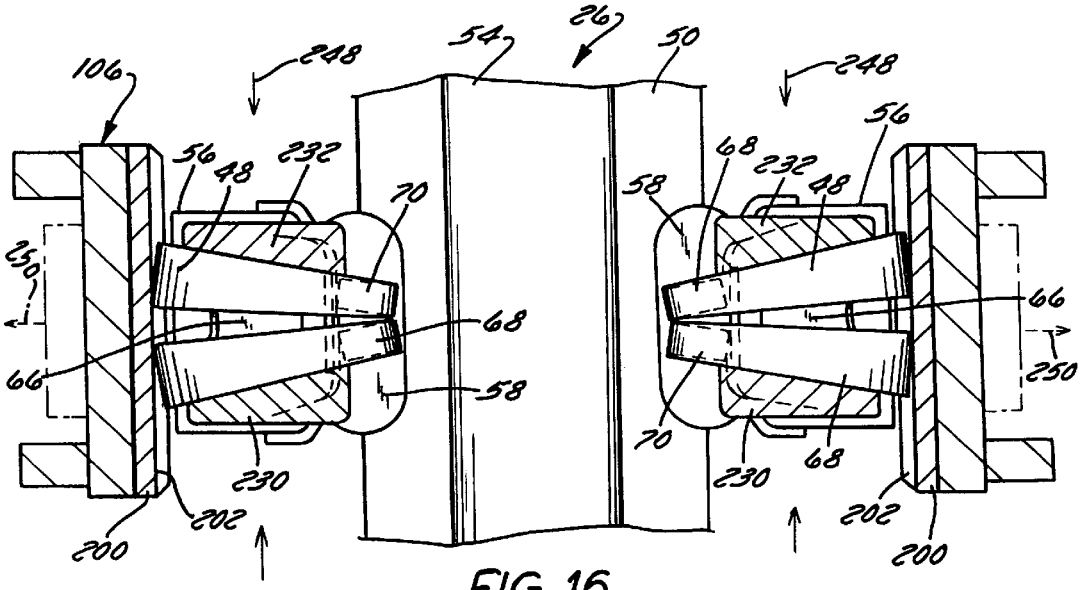
FIG. 16 is a top plan view illustrating an intermediate phase of a rail clip removal operation in which the clips are pinched or compressed to permit subsequent removal.

Second, the cylinder 218 of each clip retractor tool 108 is actuated to rotate the first and second retractor arms 212 and 214 from the position illustrated in FIG. 8 to the position illustrated in FIG. 9, thereby compressing the clip 48 as seen by the arrows 248 in FIGS. 9 and 16.The toes or ends of the arms 68 and 70 of the clip 48 are now positioned in the space located between the stops formed by the walls 62 and 64 of the socket 56 so that the clip 48 is free to be withdrawn from the socket 56. Should there be any misalignment between the clip retractor tool 108 and the clip 48 during this process such that one of the retractor arms 212 or 214 contacts the clip 48 before the other, this misalignment is compensated for by movement of the clip retractor tool 108 relative to the workarm 102 or 104 by linear movement of the cap screws 240 along the horizontal slots 242 in the block 188.

The compressive forces imposed by the retractor arms 212 and 214 are preferably much higher than would normally be required to squeeze the arms 68 and 70 together because small stones and other materials forming the ballast for the ties 46 often become lodged between the arms 68 and 70 of the clips 48. If the clip retractor tool 108 is to operate consistently under field conditions, the forces imposed by the arms 68 and 70 must be of sufficient magnitude to crush these materials. The clip retractor tool 108 is large and robust enough to achieve this objective.

Third, the cylinder 160 is extended so that the clip retractor tool 108 moves with the workarm 102 or 104 to pull the clip 48 away from the rail 24 or 26 as represented by the arrows 250 in FIG. 16. Preferably, the stop assemblies 166 on the workarms 102 and 104 are set such that the clips 48 are not retracted all the way from the sockets 56 but instead are left in a position in which they are loosely inserted or set in the sockets 56, thereby facilitating subsequent retrieval or clip reapplication.

After the clip application and/or removal operation is complete, the clamping forces imposed by the rail clamp assemblies 110 and 112 are relaxed, and the chassis 22 is propelled to the next tie 46 to effect the same operation on the clips 48 associated therewith.

Many changes and modifications may be made to the invention as described herein without departing from the spirit of the invention. The scope of these changes will become apparent from the appended claims.

I claim:

1. A clip applicator/remover machine for applying and removing a rail clip, said machine comprising:

(A) a support frame;

(B) a workarm which is supported on said support frame so as to be movable transversely with respect to a longitudinal centerline of a rail;

(C) a clip applicator tool mounted on said workarm and configured to engage the clip when said workarm moves transversely towards the longitudinal centerline of the rail; and (D) a clip retractor tool which is mounted on said workarm and which is configured to laterally compress the clip and to move the clip transversely away from the longitudinal centerline of the rail while the clip is laterally compressed.

2. A clip applicator/remover machine for applying and removing a rail clip, said machine comprising:

(A) a support frame;

(B) a workarm which is supported on said support frame so as to be movable transversely with respect to a longitudinal centerline of a rail;

(C) a clip applicator tool mounted on said workarm and configured to engage the clip when said workarm moves transversely towards the longitudinal centerline of the rail; and (1) a clip retractor tool which is supported on said support frame and which is configured to laterally compress the clip and to move the clip transversely away from the longitudinal centerline of the rail while the clip is laterally compressed, wherein said workarm is supported directly on said support frame by being pivotably mounted on said support frame, and wherein said clip retractor tool is supported indirectly on said support frame by being mounted on said workarm.

3. A clip applicator/remover machine as defined in claim 2, wherein said support frame comprises a workhead frame, and further comprising a self-propelled chassis on which said workhead frame is mounted.

4. A clip applicator/remover machine as defined in claim 2, wherein said clip retractor tool comprises a housing mounted on said workarm, and first and second retractor arms pivotably mounted on said housing, each of said first and second retractor arms having a downwardly-extending finger configured to engage a side of the clip.

5. A clip applicator/remover machine as defined in claim 4, wherein said housing is supported on said workarm by pins which ride in slots in said workarm so as to permit limited linear movement of said housing relative to said workarm.

6. A clip-applicator/remover machine as defined in claim 2, wherein said clip applicator tool comprises a drive plate mounted on a lower end of said workarm, a surface of said drive plate having a shape which compliments the shape of an outer surface of the clip.

7. A clip applicator/remover machine for applying and removing a rail clip from a rail, comprising:

(A) a self-propelled chassis;

(B) a workhead frame mounted on said chassis and extending substantially in parallel with a longitudinal centerline of the rail;

(C) a workarm mounted on said workhead frame so as to be movable transversely with respect to said workhead frame;

(D) a clip applicator tool mounted on said workarm and movable into and out of driving engagement with the clip upon transverse movement of said workarm with respect to said workhead frame; and (E) a clip retractor tool mounted on said workarm and movable, independently of said workarm, into and out of compressive engagement with the clip.

8. A clip applicator/remover machine as defined in claim 7, wherein said workhead frame is capable of limited transverse movement with respect to said chassis.

9. A clip applicator/remover machine as defined in claim 8, wherein said chassis comprises a main frame, and wherein said workhead frame is attached to said main frame by a pair of longitudinally spaced guide rods, each of said guide rods being received in an upper trunion block and a lower trunion block, each said upper trunion block being pivotably mounted on said main frame and each said lower trunion block being spring-biased into a position proximate a vertical plane running through the longitudinal centerline of the rail.

10. A clip applicator/remover machine as defined in claim 7, wherein said workarm is pivotably attached to said workhead frame by a cam device which permits limited vertical movement of said workarm relative to said workhead frame.

11. A clip applicator/remover machine as defined in claim 7, wherein said workarm comprises a first workarm disposed transversely outwardly of a field side of the rail, and wherein said clip applicator tool comprises a first clip applicator tool and said clip retractor tool comprises a first clip retractor tool, and further comprising a second workarm disposed transversely inwardly of a gauge side of the rail and being movable transversely with respect to said workhead frame, a second clip applicator tool mounted on said second workarm and movable into and out of driving engagement with a second rail clip upon transverse movement of said second workarm relative to said workhead frame, a second clip retractor tool mounted on said second workarm and movable, independently of said second workarm, into and out of compressive engagement with the second clip, and a piston and cylinder device pivotably connected to said first and second workarms and operable to drive said first and second workarms to move transversely with respect to said workhead frame.

12. A clip applicator/remover machine as defined in claim 7, further comprising adjustable stops which are mounted on said workarm and which define inner and outer limits of transverse motion of said workarm relative to said workhead frame.

13. A clip applicator/remover machine as defined in claim 7, further comprising first and second longitudinally-spaced rail clamp assemblies mounted on said workhead frame, each of said rail clamp assemblies comprising first and second transversely spaced rollers, each roller of each said rail clamp assembly being mounted on a pivot arm which is pivotably mounted on said workhead frame, both of said pivot arms of each said rail clamp assembly being pivotable under the action of a single vertically-oriented piston and cylinder device operatively connected to both of said pivot arms.

14. A clip applicator/remover machine assembly as defined in claim 7 wherein said clip retractor tool comprises a housing mounted on said workarm, and first and second retractor arms pivotably mounted on said housing, each of said first and second retractor arms having a downwardly-extending finger configured to engage a side of the clip.

15. A clip applicator/remover machine as defined in claim 14, wherein said housing is supported on said workarm by pins which ride in slots in said workarm so as to permit limited linear movement of said housing relative to said workarm.

16. A clip applicator/remover machine as defined in claim 15, wherein said first and second retractor arms include intermeshing teeth which cause said second retractor arm to pivot upon pivoting of said first retractor arm.

17. A clip applicator/remover machine as defined in claim 7, wherein said clip applicator tool comprises a drive plate mounted on a lower end of said workarm, a surface of said drive plate having a shape which complements the shape of an outer surface of the clip.

18. A clip applicator/remover machine as defined in claim 17, wherein said drive plate of said clip applicator tool is supported on said workarm by pins that permit limited vertical movement of said drive plate relative to said workarm so as to accommodate vertical movement of the clip during a clip application procedure.

* * * * *